United States Patent [19]

Lorz et al.

[11] Patent Number: 4,749,444

[45] Date of Patent: Jun. 7, 1988

[54] PRODUCTION OF PAPER AND CARDBOARD

[75] Inventors: Rudolf Lorz, Lambsheim; Friedrich Linhart, Heidelberg; Werner Auhorn, Frankenthal; Manfred Matz, Ludwigshafen, all of Fed. Rep. of Germany

[73] Assignee: BASF Aktiengesellschaft, Ludwigshafen, Fed. Rep. of Germany

[21] Appl. No.: 920,604

[22] Filed: Oct. 20, 1986

[30] Foreign Application Priority Data

Nov. 21, 1985 [DE] Fed. Rep. of Germany ..... 3541163

[51] Int. Cl.[4] ..... D21H 3/58

[52] U.S. Cl. ..... 162/168.3; 162/181.8; 162/183

[58] Field of Search ..... 162/168.1, 168.2, 181.8, 162/183, 168.3

[56] References Cited

U.S. PATENT DOCUMENTS 2,795,545 6/1957 Gluesenkamp ..... 162/181.8
3,021,257 2/1962 Stauffenberg .
3,052,595 9/1962 Pye .
4,305,781 12/1981 Langley et al. .

FOREIGN PATENT DOCUMENTS 0017353 10/1980 European Pat. Off. .

OTHER PUBLICATIONS

Casey, *Pulp and Paper*, vol. III, (1981), pp. 1602, 1603.
Abstract Bulletin of the Institute of Paper Chemistry, vol. 51, No. 11, May 1981, p. 1161, Summary No. 10862(T), Tappi, vol. 56, No. 3, Mar. 1973, pp. 83–86.

*Primary Examiner*—Peter Chin
*Attorney, Agent, or Firm*—Oblon, Fisher, Spivak, McClelland & Maier

[57] ABSTRACT

Paper and cardboard are produced by draining a paper stock by a method in which a stock having a consistency of from 2.5 to 5% by weight is used as a starting material, and (a) from 0.1 to 2% by weight of an activated bentonite are added and the stock consistency is then brought to 0.3–2% by weight by dilution with water, after which (b) from 0.01 to 0.1% by weight of a cationic polyelectrolyte having a charge density of not less than 4 meq/g of polyelectrolyte is added and distributed therein, and, after thorough mixing (c) from 0.003 to 0.3% by weight of a high molecular weight polymer based on acrylamide or methacrylamide is metered in and mixed with the paper stock, the percentages in each case being based on dry paper stock, and the resulting pulp is drained on a wire. The paper obtained is distinguished in particular by good printing properties in the offset printing process.

5 Claims, No Drawings

PRODUCTION OF PAPER AND CARDBOARD

German Laid-Open Application DOS No. 2,262,906 discloses that mixtures of bentonite and polyamidoamines, polyetheramines or polyethyleneimines can be used as drainage aids for pulps containing troublesome materials in the production of paper and cardboard. However, the paper machine speeds achievable with this system of aids are still unsatisfactory. Moreover, this process gives paper grades having unsatisfactory printing properties.

U.S. Pat. No. 3,052,595 discloses a process for the production of, in particular, filler-containing papers, in which the paper stock is drained in the presence of bentonite and polyacrylamides. Although this results in greater filler retention in the paper, even the small amounts of polyacrylamide produce excessive flocculation in the paper, so that irregularities are produced in the paper and on the surface of the paper. These papers possess poor printing properties.

European Patent 17,353 discloses a process for the production of paper or cardboard from an aqueous suspension of cellulose fibers, in which a virtually filler-free stock suspension is dewatered, with sheet formation, using a mixture of water-soluble, high molecular weight, essentially nonionic polymers and a bentonite-like clay. Suitable polymers are essentially polyacrylamides. Even in a virtually filler-free system, the polyacrylamides produce pronounced flocculation in the paper stock itself, this flocculation having an adverse effect on the quality of the papers. The formation and surface quality of the papers thus produced do not meet the requirements set in respect of the printing properties of the papers. When such papers are printed by the offset method, fibers and fine materials become detached from the paper surface.

It is an object of the present invention to provide a process for the production of paper and cardboard which makes it possible to produce papers which exhibit good formation and surface quality and have good printing properties.

We have found that this object is achieved, according to the invention, by a process for the production of paper and cardboard by draining a paper stock which contains bentonite and a polyelectrolyte on a wire, if (a) from 0.1 to 2% by weight of an activated bentonite is added to an aqueous pulp whose stock consistency is from 2.5 to 5% by weight and the stock consistency is then brought to 0.3–2% by weight by dilution with water, (b) from 0.01 to 0.1% by weight of a cationic polyelectrolyte having a charge density of not less than 4 meq/g of polyelectrolyte is added and distributed therein, and, after thorough mixing, (c) from 0.003 to 0.03% by weight of a high molecular weight polymer based on acrylamide or methacrylamide is metered in and mixed with the paper stock, and the resulting pulp is drained on a wire, the percentages of (a), (b) and (c) each being based on dry paper stock.

Using this process, it is possible to make any grade of paper, for example papers for newsprint (letterpress/-offset printing), medium-fine writing and printing papers, uncoated gravure printing papers and light-weight base papers. Such papers are produced using, as the principal raw material, groundwood, thermomechanical pulp (TMP), chemo-thermomechanical pulp (CTMP), pressure-ground wood (PGW), and sulfite and sulfate pulp, each of which may contain short or long fibers. Other suitable raw materials for the preparation of the pulps are chemical pulp and groundwood, which is directly processed further in integrated factories in a more or less moist form, without prior thickening or drying, to give paper, and, because of the incomplete removal of impurities from the digestion, still contains substances which present serious problems in the conventional papermaking process. In the novel process, it is possible to produce both filler-free and filler-containing papers. The maximum filler content of the paper can be 30% by weight but is preferably from 5 to 25% by weight. Examples of suitable fillers are clay, kaolin, chalk, talc, titanium dioxide, calcium sulfate, barium sulfate, alumina, satin white or mixtures of the stated fillers. Where filler-containing papers are produced, an aqueous suspension of fibers and filler is first prepared. The consistency of the aqueous pulp is initially from 2.5 to 5% by weight and includes the content of fibers, fines and fillers. In the novel process, from 0.1 to 2, preferably from 0.5 to 1.5, % by weight of an activated bentonite are added, in process stage (a), to a pulp whose consistency is from 2.5 to 5% by weight. Only after this is the stock consistency brought to 0.3–2% by weight by dilution with water.

The term bentonite is understood as embracing very generally sheet silicates which are swellable in water. These are primarily the clay mineral montmorillonite and similar clay minerals, e.g. nontronite, hectorite, saponite, volkonskoite, sauconite, beidellite, allevardite, illite, halloysite, attapulgite and sepiolite. The sheet silicate must be swellable in water and, in extreme cases, be able to disintegrate into its elementary layers as a result of the swelling. If this is not a natural property, the sheet silicate has to be activated before being used, i.e. converted to its water-swellable sodium, potassium, ammonium or hydroxonium form. This type of activation of the bentonites is achieved by treating the sheet silicates with the appropriate bases or sodium carbonate or potassium carbonate. A sodium bentonite is preferably used for the application according to the invention.

The activated bentonite is added to the aqueous pulp in an amount of from 0.1 to 2, preferably from 0.5 to 1.5, % by weight, based on dry paper stock. The bentonite can be added either in solid form or, preferably, in the form of an aqueous suspension.

From 0.01 to 0.1, preferably 0.03 to 0.06, % by weight, based on the dry paper stock, of a cationic polyelectrolyte which has a charge density of not less than 4 meq/g of polyelectrolyte at pH 4.5 is then added to the pulp, which contains an activated bentonite in the above amount. The charge density is determined according to D. Horn, Polyethyleneimine/Physicochemical Properties and Application (IUPAC), Polymeric Amines and Ammonium Salts, Pergamon Press Oxford and New York, 1980, pages 333–355.

The cationic polyelectrolytes of component (b) have a high charge density. These compounds are, for example, the following polymers: polyethyleneimines, polyamines having a molecular weight of more than 50,000, polyamidoamines modified by grafting on ethyleneimine, polyamidoamines, polyetheramines, polyvinylamines, modified polyvinylamines, polyalkylamines, polyvinylimidazoles, polyvinylpyridines, polyvinylimidazolines, polyvinyltetrahydropyridines, polydialkylaminoalkyl vinyl ethers, polydialkylaminoalkyl (meth)acrylates, and polydialkylaminoalkyl (meth)-acrylamides in protonated or quarternized form. Other suitable compounds of this type are polydiallyldialkyl ammonium halides, in particular polydiallyldimethylammonium chloride. The polyelectrolytes are soluble in water and are used in the form of the aqueous solutions.

Polyethyleneimines are prepared, for example, by polymerization of ethyleneimine in aqueous solution in the presence of an acidic catalyst, by a conventional process. Modified polyethyleneimines are obtained if polyethyleneimines are crosslinked to an extent such that the resulting polymers are still water-soluble. Examples of suitable crosslinking agents are epichlorohydrin, dichloroethane and xylylene dichloride.

Water-soluble condensates containing ethyleneimine as condensed units are prepared, for example, by first condensing 1 mol of a dicarboxylic acid of 4 to 10 carbon atoms with from 1 to 2 moles of a polyalkylene polyamine having from 3 to 10 basic nitrogen atoms in the molecule to give polyamidoamines, then grafting ethyleneimine onto the condensates, and reacting the ethyleneimine-modified polyamidoamines with a crosslinking agent so that water-soluble condensates are obtained. Examples of suitable crosslinking agents are epichlorohydrin (cf. German Pat. No. 1,802,435) and polyalkylene oxides containing from 8 to 100 alkylene oxide units whose terminal OH groups have been reacted with not less than an equivalent amount of epichlorohydrin (cf. German Pat. No. 2,434,816). Other suitable components (b) are the condensates disclosed in German Published Application DAS No. 1,771,814, which are crosslinked products of polyamidoamines with bifunctional crosslinking agents. Cationic polyelectrolytes having a high charge density are also obtained by condensation of dior polyamines, such as ethylenediamine, diethylenetriamine, triethylenetetramine and the higher homologs, with crosslinking agents, such as dichloroethane, epichlorohydrin and the reaction products of polyethylene glycols and epichlorohydrin in a molar ratio of 1 to not less than 2, or by reacting primary or secondary amines, such as methylamine or dimethylamine, with epichlorohydrin, dichloroethane, dichloropropane or dichlorobutane. Polyvinylamines are prepared by polymerizing N-vinyl-formamide and hydrolyzing the resulting polymers by the action of an acid or base, the formyl groups being eliminated from the polymer. Other very effective polymers are those which contain N-vinylformamide and vinylamine as copolymerized units. Such polymers are prepared by partial hydrolysis of polyvinylformamides. The polymers of vinyl-heterocycles are obtained by polymerizing the monomers on which these polymers are based, for example polymerizing N-vinylimidazole or its derivatives, e.g. 2-methyl-1-vinylimidazole or 2-benzyl-1-vinylimidazole, N-vinylpyridine or its derivatives and N-vinylimidazolines, e.g. 2-methyl-1-vinyl-imidazoline, 2-phenyl-1-vinylimidazoline or 2-benzyl-1-vinylimidazoline. The heterocyclic cationic monomers are preferably used in neutralized or quarternized form in the polymerization. Other suitable cationic polyelectrolytes (b) are di-$C_1$–$C_3$-alkylamino-$C_2$–$C_6$alkyl (meth)acrylates, di-$C_1$–$C_3$-alkylamino-$C_2$–$C_6$-alkyl(meth)acrylamides and dialkylaminoalkyl vinyl ethers. Another class of compounds which can be used as component (b) comprises polymerized diallyldi-$C_1$–$C_3$-alkylammonium halides, in particular polydiallyldimethylammonium chloride. Other suitable polymers are those which are obtainable by a polymeranalogous reaction of polyacrylamide with formaldehyde and secondary amines, e.g. dimethylamine. Preferably used compounds for component (b) are polyethyleneimine, watersoluble crosslinked condensates which contain ethyleneimine as condensed units and are based on polyamidoamines, polyvinylamines, polydiallylammonium chloride and/or not less than 10 mol % of hydrolyzed poly-N-vinylformamides. The molecular weight of the cationic polyelectrolytes of component (b) is from 50,000 to 3,000,000, preferably from 200,000 to 2,000,000. Polymers of this type are known and the majority are commercially available. The charge density of the cationic polyelectrolyte at pH 4.5 is preferably from 5 to 20 meq/g of polyelectrolyte.

After component (b) has been mixed thoroughly with the paper stock, high molecular weight polymer based on acrylamide or methacrylamide is metered into the pulp, as component (c). This polymer too is mixed with the paper stock, which is then drained in a conventional manner on a wire. From 0.003 to 0.03, preferably from 0.005 to 0.015 % by weight, based on dry paper stock, of a high molecular weight polymer of component (c) is used. This group of polymers includes the homopolymers of acrylamide and methacrylamide and the copolymers of the two monomers with anionic or cationic monomers. The homo- and copolymers have a weight average molecular weight (determined by the light scattering method) of from 1 million to 20 million. Anionically modified polymers of acrylamide or methacrylamide are obtained by copolymerization of acrylamide or methacrylamide with monoethylenically unsaturated $C_3$–$C_5$-carboxylic acids which may be partially or completely neutralized, or by partial hydrolysis of the amide groups of an acrylamide or methacrylamide homopolymer. Among the anionically modified polyacrylamides, the copolymers of acrylamide and acrylic acid are mainly used. The content of copolymerized acrylic acid in the copolymer can be from 5 to 80% by weight.

The cationic modification of the (meth)acrylamide polymers is carried out using, for example, $C_1$- or $C_2$-alkylamino-$C_2$–$C_6$-alkyl (meth)acrylates, e.g. diethylaminoethyl acrylate, dimethylaminoethyl acrylate, dimethylaminoethyl methacrylate, dimethylaminopropyl acrylate, dimethylaminobutyl acrylate, dimethylaminoneopentyl acrylate and the corresponding methacrylates, these monomers being subjected to the copolymerization in the form of the salt with hydrochloric acid or sulfuric acid or in quarternized form, for example quaternized by reaction with methyl chloride, dimethyl sulfate or benzyl chloride. Other suitable cationic monomers for modifying the (meth)acrylamide polymers are dialkylaminoalkyl(meth)acrylamides, dialkylaminoalkyl vinyl ethers, N-vinylimidazoles, N-vinylpyridine and diallyldimethylammonium chloride. Preferably used components (c) for the novel process are polyacrylamide and copolymers of acrylamide and acrylic acid, of acrylamide and dimethylaminoethyl acrylate, of acrylamide and diethylaminoethyl acrylate, of acrylamide and N-vinyl-imidazoline, of acrylamide and 2-methyl-1-vinylimidazoline and of acrylamide and 2-phenyl-1-vinylimidazoline. The cationic monomers are used in neutralized or quarternized form.

Where chemically similar compounds (b) and (c) are used in the novel process, the two classes of compounds differ in that the compounds (c) have a molecular weight which is not less than 1 million higher than the molecular weight of compounds (b). Another distinguishing feature of the two classes of compounds (b) and (c) is the charge density. Where they have been cationically modified, the compounds (c) have a maximum charge density of 3.5 meq/g of polyelectrolyte (measured at pH 4.5). Anionic modification of the polyacrylamides may also be carried out using vinyl sulfonic acid, acrylamidopropane sulfonic acids and/or their alkali metal, ammonium or amine salts.

In papermaking, an aqueous pulp whose consistency is from 2.5 to 5% by weight is used as a starting material. The activated bentonite is added to this pulp in the above amounts. The bentonite is preferably added in the form of a 3–6% strength aqueous dispersion. The pulp which contains the bentonite is then diluted with water. In the production plant, the backwater is preferably used for this purpose. One or more compounds (b) are then metered, in the above amount, into the dilute stock suspension, for example into the line at the exit of the mixing pump. Because of the flow characteristics in the pipeline system, adequate mixing of the cationic polymer with the paper stock takes place. As soon as the components have been adequately mixed with one another, the high molecular weight polymer of component (c) can be added. In each case, the compounds (c) are added upstream of the headbox, advantageously at a point between the pressure screen and the headbox. The polymers (b) and (c) are preferably metered in as dilute aqueous solutions. Because of the auxiliary system used, papermaking can be carried out using closed water circulations. The paper obtained has good printing properties, this being the case for the offset process too.

In the Examples, parts and percentages are by weight. The charge density and the molecular weight (light scattering) were determined according to D. Horn, Polyethyleneamine/Physichochemical Properties and Application (IUPAC) Polymeric Amines and Ammonium Salts, Pergamon Press Oxford and New York, 1980, pages 333–355.

Determination of the drainage time: 1 l of the fiber suspension to be tested is drained in a Schopper-Riegler tester. The time determined for various volumes discharged is used as a criterion for the drainage rate of the particular stock suspension investigated. The drainage times were determined in all the cases stated here after 150, 200 and 250 ml of water had been discharged.

The retention was tested by determining in each case the solids content of 250 ml of a filtrate obtained by draining the fiber suspension being tested, in a Schopper-Riegler apparatus.

The following starting materials were used:

Polyelectrolyte 1 (component b)

This was a polyamidoamine of adipic acid and diethylenetriamine, which had been grafted with ethyleneimine and crosslinked with a polyalkylene oxide whose terminal OH groups had been reacted with epichlorohydrin. A product of this type is disclosed in Example 1 of German Pat. No. 2,434,816; it has a charge density of 12.2 meq/g (measured at pH 4.5).

High molecular weight polymer 1 (component c): a homopolymer of acrylamide having a molecular weight of 3.5 million was used.

EXAMPLE 1

A stock suspension of thermomechanicalpulp (TMP) having a concentration of 3.2% is prepared in a 20 l vessel. The pH of the stock suspension is 5.7. The fiber suspension prepared in this manner is stirred and a 5% strength aqueous suspension of a commercial sodium bentonite is added, so that the amount of bentonite is 0.5%, based on paper stock. After homogenization, the stock is diluted to a concentration of 0.85% by adding water.

In experiment (a), the drainage times and the retention of this stock suspension are measured. The values determined are stated in Table 1.

(b)

0.06%, based on dry paper stock, of polyelectrolyte 1 stated above is added to the stock suspension obtained as described in (a). After thorough mixing, the drainage time is measured and the retention determined. When the state of flocculation is checked visually, only a low level of flocculation is observed. The results are shown in Table 1.

(c)

0.02% of the high molecular weight polymer 1 stated above is added to the stock suspension obtained as described in (a), the mixture is mixed thoroughly and the drainage time, the retention and flocculation are then determined. The results are shown in Table 1. The fact that pronounced flocculation occurs is noteworthy here.

(d) Example according to the invention 0.06% of polyelectrolyte 1 is first added to 1 l of the bentonite-containing stock suspension obtained as described in (a), and the mixture is stirred for 1 minute. Thereafter, 0.02% of the high molecular weight polymer 1 is added, the mixture is stirred for a further minute, and the drainage and retention are checked by the stated method. It is noteworthy that the system exhibits only a low level of flocculation.

TABLE 1

| After the passage of . . . ml | Drainage time [sec] in the Schopper-Riegler tester | | | |
|---|---|---|---|---|
| | (a) | (b) | (c) | (d) |
| 150 | 34 | 33 | 26 | 29 |
| 200 | 70 | 70 | 57 | 52 |
| 250 | 122 | 122 | 85 | 93 |
| mg of solids per 250 ml of backwater | 138 | 135 | 81 | 78 |
| Flocculation | none | little pronounced little | | |

EXAMPLE 2

Offset quality filler-free newsprint having a basis weight of 52 g/m$^2$ is made from 100% bleached TMP on a paper machine. A stock having a consistency of 2.95% is used as a starting material, and 0.7% of sodium bentonite in the form of 5% strength aqueous suspension is added by a continuous procedure. The paper stock is then diluted in the mixing pump with backwater to a consistency of 0.75%, and 0.05%, based on dry paper stock, of the above polyelectrolyte 1 is metered into the line at the exit of the mixing pump. After thorough mixing, 0.01% of the high molecular weight polymer 1 is metered in between the pressure screen and headbox. After the system has reached equilibrium, the values for the headbox and backwater are determined and are used to calculate the values for the first pass retention (FPR). The machine speed and the paper production per unit time are determined as further parameters.

The concentration in the headbox is 6.84 g/l, while the backwater contains 2.32 g/l of solids. The first pass retention (FPR) is 66.1%. The production rate is 577 m/min, and 6.8 t of paper are obtained per hour.

COMPARATIVE EXAMPLE 2

Example 1 is repeated, except that polyelectrolyte 1 is omitted. In this case, the paper stock flocculates to such an extent that satisfactory sheet formation is not ensured. The formation and surface quality of the sheet does not meet the print requirements set.

COMPARATIVE EXAMPLE 3

Example 2 is repeated, except that the high molecular weight polymer 1 is omitted. In this case, good formation is achieved but drainage of the paper stock is poor, so that the machine can only run at a low speed.

We claim:

1. A process for the production of paper and cardboard by draining a paper stock, wherein (a) from 0.1 to 2% by weight of a water-swellable bentonite is added to an aqueous pulp whose stock consistency is from 2.5 to 5% by weight and the stock consistency is then brought to 0.3–2% by weight by dilution with water, (b) from 0.01 to 0.1% by weight of a cationic polyelectrolyte having a charge density of not less than 4 meq/g (measured at pH 4.5) of polyelectrolyte is added and distributed therein, and after thorough mixing, from (c) 0.003 to 0.03% by weight of a high molecular weight polymer based on acrylamide or methacrylamide having a maximum charge density of about 3.5 meq/g (measured at pH 4.5) is metered in and mixed with the paper stock, and the resulting pulp is drained on a wire, the percentages of (a), (b) and (c) each being based on dry paper stock.

2. A process as claimed in claim 1, wherein polyethyleneimines, water-soluble crosslinked condensates containing ethyleneimine as condensed units and based on polyamidoamines, polyetheramines, polyvinylamines, polydiallylammonium chloride and/or not less than 10 mol % of hydrolyzed poly-N-vinylformamides are used as component (b).

3. A process as claimed in claim 1, wherein homopolymers of acrylamide and methacrylamide which have a weight average molecular weight of from 1,000,000 to 20,000,000 are used as component (c).

4. A process as claimed in claim 1, wherein copolymers of acrylamide and one or more anionic monomers from the group consisting of the ethylenically unsaturated $C_3$–$C_5$-carboxylic acids, vinylsulfonic acid, acrylamidopropanesulfonic acids and/or their alkali metal, ammonium and amine salts are used as component (c).

5. A process as claimed in claim 1, wherein copolymers of acrylamide and one or more cationic monomers from the group consisting of di-$C_1$- or $C_2$-alkylamino-$C_2$-alkyl $C_6$-(meth)acrylates, di-$C_1$- or $C_2$-alkylamino-$C_6$–$C_2$-alkyl (meth)acrylamides, N-vinylimidazoles, N-vinylpyridines and N-vinylimidazolines, if appropriate in quarternized form or as salts, and diallyldi-$C_1$- or $C_2$-alkylammonium halides are used as component (c).

* * * * *